US011225371B2

(12) United States Patent
Nasr et al.

(10) Patent No.: US 11,225,371 B2
(45) Date of Patent: Jan. 18, 2022

(54) VALVE ASSEMBLY FOR AN AEROSOL SPRAY DEVICE

(71) Applicant: The Salford Valve Company LTD, North Yorkshire (GB)

(72) Inventors: Ghasem Nasr, North Yorkshire (GB); Thomas Guy Goldberg, North Yorkshire (GB); Greig Tulloch, North Yorkshire (GB); Amir Nourian, North Yorkshire (GB)

(73) Assignee: The Salford Valve Company LTD, North Yorkshire (GB)

( * ) Notice: Subject to any disclaimer, the term of this patent is extended or adjusted under 35 U.S.C. 154(b) by 64 days.

(21) Appl. No.: 16/497,691

(22) PCT Filed: Mar. 28, 2018

(86) PCT No.: PCT/GB2018/050838

§ 371 (c)(1),
(2) Date: Sep. 25, 2019

(87) PCT Pub. No.: WO2018/178685

PCT Pub. Date: Oct. 4, 2018

(65) Prior Publication Data

US 2021/0107728 A1 Apr. 15, 2021

(51) Int. Cl.
*B65D 83/48* (2006.01)
*B65D 83/38* (2006.01)
(Continued)

(52) U.S. Cl.
CPC ..... *B65D 83/48* (2013.01); *B65D 83/38* (2013.01); *B65D 83/32* (2013.01); *B65D 83/752* (2013.01)

(58) Field of Classification Search
CPC .... B65D 83/48; B65D 83/3832; B65D 83/50; B65D 83/752; B65D 88/44
(Continued)

(56) References Cited

U.S. PATENT DOCUMENTS 2,658,714 A * 11/1953 Haskell ..... B65D 83/205 251/353
2,912,173 A * 11/1959 Edwards ..... B65D 83/48 239/471
(Continued)

FOREIGN PATENT DOCUMENTS

CH 325306 A 10/1957
CN 1594046 A 3/2005
(Continued)

*Primary Examiner* — Lien M Ngo
(74) *Attorney, Agent, or Firm* — Husch Blackwell LLP

(57) ABSTRACT

A valve assembly (100, 500) for a pressurised or pressurisable container of an aerosol spray device is disclosed, wherein a valve stem (120) of the valve assembly (100, 500) is moveable between: a closed position in which a first sealing means (144) is biased against a second sealing means (148, 548) by a biasing means (146) such that a housing inlet (112) is not in fluid communication with an at least one valve stem inlet (178, 184); and an open position in which the first sealing means (144) is displaced from the second sealing means (148, 548) by a proximal end (174) of the valve stem (120) such that the housing inlet (112) is in fluid communication with the at least one valve stem inlet (178, 184), wherein, in the open position, a flow path is created from the housing inlet (112), around the outside of the first sealing means (144), and to the at least one valve stem inlet (178, 184).

19 Claims, 7 Drawing Sheets

(51) Int. Cl.
*B65D 83/32* (2006.01)
*B65D 83/14* (2006.01)

(58) Field of Classification Search
USPC ..... 222/402.1, 402.21–402.25, 145.2, 145.5
See application file for complete search history.

(56) References Cited

U.S. PATENT DOCUMENTS 2,965,270 A * 12/1960 Soffer ..... B65D 83/46 222/402.22
4,401,271 A * 8/1983 Hansen ..... B65D 83/303 239/337
4,887,744 A * 12/1989 Williams ..... B05B 11/3023 222/402.1
4,940,170 A * 7/1990 Popp-Ginsbach ..... B65D 83/20 138/45
5,690,256 A * 11/1997 Smith ..... B65D 83/206 222/402.1
7,341,169 B2 * 3/2008 Bayer ..... B65D 83/34 222/402.24
7,374,068 B2 * 5/2008 Greer, Jr. ..... B65D 83/306 222/1
7,455,199 B2 * 11/2008 Cockings ..... B65D 83/20 222/389
7,984,834 B2 * 7/2011 McBroom ..... B65D 83/44 222/402.1
8,336,742 B2 * 12/2012 Greer, Jr. ..... B65D 83/752 222/402.1
10,029,844 B2 * 7/2018 Seki ..... B65D 83/38
2006/0219740 A1 10/2006 Bayer
2012/0043353 A1 * 2/2012 Davideit ..... B65D 83/48 222/402.1
2014/0158719 A1 6/2014 Davideit et al.
2016/0377231 A1 * 12/2016 Smith ..... F16K 1/30 251/325

FOREIGN PATENT DOCUMENTS

CN 205114097 U 3/2016
DE 1040464 B 10/1958
FR 1220570 A 5/1960

* cited by examiner

VALVE ASSEMBLY FOR AN AEROSOL SPRAY DEVICE

FIELD OF THE INVENTION

The present invention relates to a valve for a fluid dispensing apparatus. More particularly, the present invention relates to a valve for an aerosol spray device suitable for dispensing a highly viscous product.

BACKGROUND TO THE INVENTION

Broadly speaking, aerosol spray devices comprise a container holding a liquid to be discharged and an outlet nozzle associated with a valve assembly which is selectively operable to allow discharge of the liquid as a spray from the nozzle by means of propellant gas also provided within the container.

Both "compressed gas propellant aerosols" and "liquefied gas propellant aerosols" are known. The former incorporate a propellant which is a gas at 25° C. and a pressure of at least 50 bar (e.g. nitrogen, carbon dioxide or air). On opening of the valve assembly, the compressed gas "pushes" liquid contained in the spray device container through the aforementioned nozzle that provides for atomisation.

There are, in fact, two types of "compressed gas propellant aerosols". In one type, only liquid from the container ("pushed-out" by the compressed gas) is supplied to the outlet nozzle. In the other principal type, a portion of the propellant gas from the container is bled into the liquid being supplied to the nozzle which atomises the resulting two-phase, bubble-laden ("bubbly") flow to produce the spray.

In contrast, "liquefied gas propellant aerosols" use a propellant present as both a gas phase and a liquefied phase which is miscible within the liquid in the container. The propellant may, for example, be butane, propane or a mixture thereof. On discharge, the gas phase propellant "propels" the liquid in container (including dissolved, liquid phase propellant through the nozzle).

Known aerosol spray devices for use with high viscous fluids, namely fluids with a viscosity greater than that of water (e.g. greater than 2 cP (2 mPa·s) at 20° C.), such as vegetable oil, olive oil, gels, some antiperspirants, hair removal cream, fire extinguishing fluid, and grease use Liquefied Petroleum Gas (LPG) as a propellant as flash vaporisation of the LPG makes it a easier to spray viscous materials. LPGs are considered to have a detrimental effect on the environment as they can contain Volatile Organic Compounds (VOCs) and greenhouse gases. However, such aerosol spray devices are still not suitable for use with products of a viscosity greater than 2 cP (2 mPa·s) at 20° C., irrespective of whether or not LPGs are used as a propellant.

Further, many conventional aerosol valves are not suitable for use with domestic or industrial high viscous products (e.g. products with a viscosity of greater than 2 cP (2 mPa·s) at 20° C. up to 100 cP (100 mPa·s) at 20° C.) as the designs of conventional valves include holes in the housing and the valve stem, such as a Vapour Phase Tap in the form of a hole in the housing of a valve which enables mixing of the product and propellant inside the housing for providing better spray and atomisation, which can easily become blocked due to the viscosity of the liquid passing through. As such, it is not possible to obtain adequate atomisation of the product from the aerosol spray device resulting in a jet emerging from the device instead of a spray.

In light of the above outlined issues with the use of conventional aerosol valves with high viscous fluids, Bag-on-Valve (BoV) type technology has been widely adopted where high viscous fluids, such as those listed above, are to be dispensed from an aerosol spray device. BoV aerosol spray devices conventionally comprise a bag welded to a valve assembly. The product to be dispensed (product) is placed inside the bag while the space in between the bag and the container is filled with the propellant. During operation, the propellant compresses the bag when valve assembly is opened causing the product to be dispensed from the aerosol spray device. The product is also mixed with other chemicals in the bag, such as isopentane, to improve atomisation.

BoV type aerosol spray devices may be used with products with a viscosity of up to 50 cP (50 mPa·s) at 20° C., but the product must be mixed with another chemical or chemicals inside the bag so as to thin the product thereby reducing the viscosity. Further there are difficulties in matching a suitable mechanical break-up unit (MBU) with the product to be dispensed as the likelihood is that the actuator cap will clog up and a jet will emerge instead of a spray. It is extremely challenging to dispense pure products with a viscosity of up to 100 cP (100 mPa·s) at 20° C., even using BoV type aerosol spray devices.

It is well recognised that the utilisation of BoV type aerosol spray devices bears significant manufacturing and assembly costs, although manufacturers and consumers have been left with no choice other than acceptance due to the lack of a viable alternative.

SUMMARY OF THE INVENTION

In an embodiment of the invention, there is provided a valve assembly for a pressurised or pressurisable container of an aerosol spray device, the valve assembly comprising: a housing with internal walls defining a valve chamber, the housing having a housing inlet for fluid communication with fluid in the container; a valve stem having a proximal end and a distal end, the proximal end received in the valve chamber and the distal end projecting through a sealed opening in the valve chamber, the valve stem including an outlet flow conduit with an outlet aperture at the distal end and, more proximally, at least one valve stem inlet; a first sealing means disposed within the valve chamber; a biasing means disposed within the valve chamber; and a second sealing means disposed within the valve chamber, wherein the valve stem is moveable between: a closed position in which the first sealing means is biased against the second sealing means by the biasing means such that the housing inlet is not in fluid communication with the at least one valve stem inlet; and an open position in which the first sealing means is displaced from the second sealing means by the proximal end of the valve stem such that the housing inlet is in fluid communication with the at least one valve stem inlet, wherein, in the open position, a flow path is created from the housing inlet, around the outside of the first sealing means, and to the at least one valve stem inlet.

This new valve assembly operates with inert gases and has advantages over conventional valves, including BoV type valves, as BoV type valves require the product to be mixed with a chemical to improve atomisation use butane propellant when dispensing a high viscous product (up to 100 cP (100 mPa·s) at 20° C.). Further, when the valve assembly of the present invention is fully open, there are negligible energy losses as fluid passes through the valve from the interior of the container to the nozzle in the actuator cap. The use of the present valve assembly thus permits all pressure drops in the valve to be controlled and minimised, resulting in improved control of atomising efficiency and flow rate, whereas in conventional valves a significant pressure drops occurs through the valve which has a complex effect on the corresponding spray.

Such a valve assembly has a loss coefficient of 10 when the valve assembly is fully open, as described in detail in what follows, and has the advantage that there are negligible energy losses when fluid passes through the valve assembly from the interior of the container to the nozzle (for this reason, and for convenience, such valve assemblies are also referred to herein as "low-loss valves"). Consequently the pressure at the entrance to the nozzle is much closer to the pressure within the container than in the case of valves normally employed in aerosols for which a significant pressure drop occurs through the valve. Such a pressure drop, as caused by the conventional valves, has a complex effect on the flow-rate (through the nozzle) and drop size of the spray.

The use of a low-loss valve permits all pressure drops, to be controlled only by the design of the insert and actuator cap. This gives the opportunity of much improved control of atomising efficiency and flow rate. The invention is applicable particularly, but not exclusively, to "compressed gas propellant aerosols", i.e. aerosol spray devices in which the propellant is a compressed gas which has the property of being a gas at 25° C. and a pressure of at least 50 bar.

The invention is applicable to "compressed gas propellant aerosols" in which only liquid in the container ("pushed-out" by the propellant gas) is passed along the fluid flow path to the nozzle (i.e. without bleed of propellant gas into the liquid flow) with the attendant advantage that the pressure at the inlet to the nozzle is closer to the pressure in the container than in prior art constructions.

In the case of "compressed gas propellant aerosols", the propellant may, for example, be nitrogen, carbon dioxide or air.

Further advantages of the valve of the present invention include that it is capable of spraying viscous products up to 100 Cp (100 mPa·s) at 20° C. or greater, no butane or other liquefied hydrocarbon gas is used as a propellant as it can be replaced with compressed air, nitrogen or another 'safe' gas propellant. Further, spray quality and consistency during the lifetime of an aerosol spray device utilising the valve assembly is assured, conventional containers and filling technology can be used, there are reduced manufacturing and assembly costs, and the valve may be used with a mechanical breakup unit (MBU).

Preferably, the at least one valve stem inlet comprises at least one opening in a sidewall of the proximal end of the valve stem.

Preferably, the at least one opening comprises one or more of a slot or hole, preferably the at least one opening comprises two diametrically opposed slots and/or two diametrically opposed holes.

Preferably, the at least one valve stem inlet is configured such that a flow path into the valve stem via the at least one valve stem inlet is in a direction perpendicular to a flow path from the at least one valve stem inlet through the valve stem to the outlet aperture.

Although the biasing means may be any suitable biasing element which is able to bias the first sealing means against the second sealing means, preferably, the biasing means is a spring.

Preferably, the biasing means is coaxially aligned with the valve stem.

Preferably, the housing is configured such that the first sealing means remains in fluid communication with the housing inlet throughout the range of movement of the valve stem.

Preferably, the housing is configured such that the first sealing means remains in alignment with a longitudinal axis of the valve stem throughout the range of movement of the valve stem.

Preferably, the biasing means is in constant contact with the first sealing means throughout the range of movement of the valve.

Although the first sealing means could be any sealing element suitable for creating a seal with the second sealing means, preferably, the first sealing means comprises a ball.

Preferably, the width of a portion of the valve chamber within which the ball is located is no more than 1.2 times the diameter of the ball.

Preferably, the width of the portion of the valve chamber within which the ball is located is 1.1 to 1.2 times the diameter of the ball.

Preferably, the width of the portion of the valve chamber within which the ball is located is 1.12 to 1.18 times the diameter of the ball.

Although the second sealing means could be any sealing element suitable for creating a seal with the first sealing means, preferably, the second sealing means comprises a gasket.

Alternatively, the second sealing means may comprise a sealing surface.

Preferably, the sealing surface is chamfered.

Preferably, the biasing means is configured to retain the first sealing means in alignment with the longitudinal axis of the valve stem.

BRIEF DESCRIPTION OF DRAWINGS

Embodiments of the present invention will now be described, by way of example only, with reference to the accompanying drawings, in which.

DETAILED DESCRIPTION

Figure 1B:
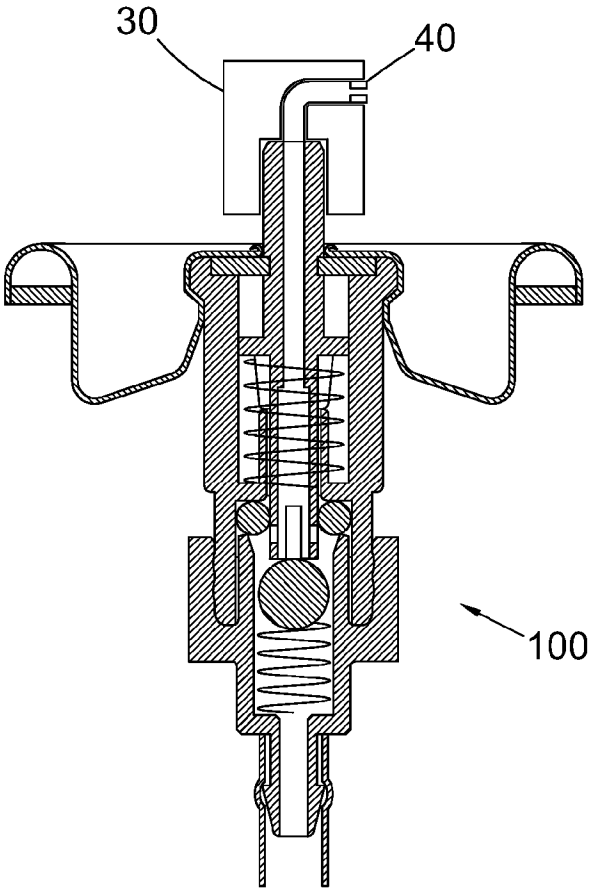
FIGS. 1*a* and 1*b* depict a cross-section of a valve assembly in a closed and an open position respectively.
Figure 1A:
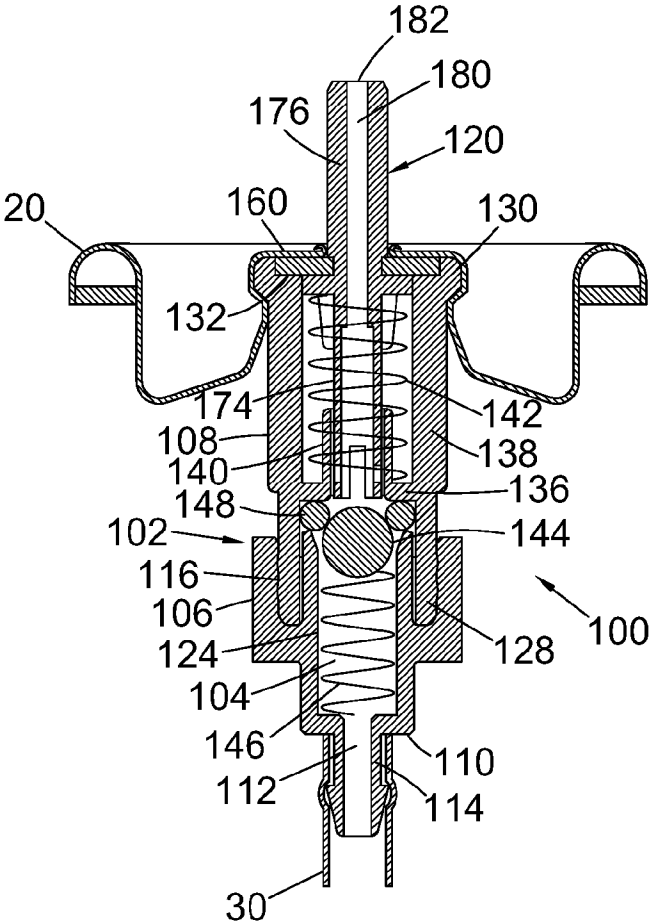

A valve assembly 100 according to the invention is illustrated in the accompanying FIGS. 1*a* and 1*b* which depict a cross-section of the valve assembly 100 in a closed and an open position respectively. Such a valve assembly is for incorporation into an aerosol spray device (not depicted) of the type generally described in the introductory portion and comprising a container (not depicted), within which the product and the propellant are contained.

Mounting cup 20 is depicted which is configured to couple the valve assembly 100 to the container of the aerosol spray device and an actuator cap 30 with a nozzle 40 as depicted in FIG. 1*b*.

The nozzle 40 (referred to as an 'insert' in the technical field) may, for example, be a "small swirl atomiser" and may be of the type known as a "mechanical break-up" (MBU) nozzle. Alternatively, the nozzle 40 may be a simple orifice. The nozzle 40 may be a special design incorporating features to maximise atomisation quality for the fluid flow. In all cases, the nozzle 40 may be provided (as conventional in aerosol technology) as an insert in an actuator cap 30 of the aerosol spray device.

Figure 2:
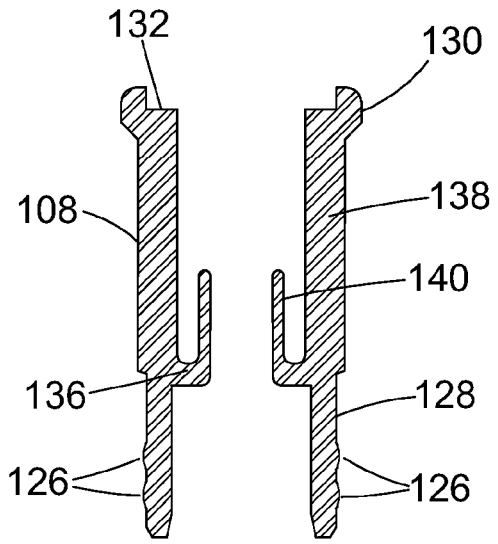
FIG. 2 depicts a cross-section of a top housing portion of the valve assembly depicted in FIGS. 1*a* and 1*b;*

The valve assembly 100 comprises a housing 102 with internal walls defining a valve chamber 104, and a valve stem 120. The housing 102 is formed of two portions: a top housing portion 108; and a bottom housing portion 106. Cross-sections of the top housing portion 108 and the bottom housing portion 106 can be seen more clearly in FIGS. 2 and 3 respectively. A cross-section of the valve stem 120 can be seen more clearly in FIG. 4. The valve assembly 100 would be crimped in place at the top of a container via the mounting cup 20, with a distal portion of the valve stem 120 projecting from the top of the container for connection to the actuator cap 30.

The bottom housing portion 106 has a lower wall 110 with an inlet aperture 112 therethrough. A tubular spigot 114 depends from the lower wall 110. A dip tube 30 is connected to the tubular spigot 114 by means of an enlarged lower end of the tubular spigot 114. The dip tube 30 extends to the base of the container (not depicted) to which the valve assembly 100 is fitted. It will be appreciated that the lower region of a container to which the valve assembly 100 is fitted is in communication with the valve chamber 104 via the dip tube, spigot 114 and inlet aperture 112 (which provides a liquid inlet for the valve chamber).

The bottom housing portion 106 comprises a generally cylindrical inner wall 124 which defines the valve chamber 104. A ball 144 is disposed within the chamber valve 104. A bottom spring 146 biases the ball 144 towards a lower annular sealing gasket 148 located between the top housing portion 108 and the bottom housing portion 106. The ball 144 may be made of a metal, such as stainless steel. The lower annular sealing gasket 148 may be a rubber O-ring.

In an alternative embodiment, the ball 144 may be replaced with any other suitably shaped sealing means.

The bottom spring 146 may also be replaced with any other suitable biasing means.

The lower annular sealing gasket 148 may also be replaced with any other suitable sealing means.

The diameter of the cylindrical inner wall 124 which defines the valve chamber 104 is preferably no more than 1.2 times the diameter of the ball 114. More preferably, the diameter of the cylindrical inner wall 124 is 1.1 to 1.2 times the diameter of the ball 144 and, even more preferably, the diameter of the cylindrical inner wall 124 is 1.12 to 1.18 times the diameter of the ball 144.

As can be seen in FIGS. 1*a* and 1*b*, the bottom spring 146 is coaxially aligned with the valve stem 120. This allows for simple manufacture and assembly of the valve assembly 100.

The upper end of the bottom housing portion 106 comprises a channel 116 configured to receive the top housing portion 108. The channel 116 further comprises annular recesses 134.

The top housing portion 108 has a narrower outer diameter at a lower end 128 so as to fit with an interference fit inside the channel 116 of the bottom housing portion 106. The lower end 128 of the top housing portion 108 comprises annular protrusions 126 which correspond to the annular recesses 134 of the channel 116 of the bottom housing portion 106. The arrangement of the annular protrusions 126 and annular recesses 134 is such that, once the lower end 128 of the top housing portion 108 is inserted into the channel 116, the top housing portion 108 is locked to the bottom housing portion 106.

At the upper end 138 of the top housing portion 108, an annular rim 130, together with an upper surface 132, defines a shelf within which an upper annular sealing gasket 160 sits.

A wall 136 extends radially inwardly from a central region between the upper end 138 and the lower end 128 of the top housing portion 108. A tubular spigot 140 extends upwardly from the wall 136. The spigot 140 supports a top spring 142, with the lower end of the top spring 142 being located around the spigot 140, and acts as a guide for the valve stem 120.

The top spring 142 engages with the wall 136 of the top housing portion 108 and biases the valve stem 120 in an upward direction towards the upper gasket 160.

The valve stem 120 is generally cylindrical, having a proximal end 174 with an outer surface 172 with a diameter equal to the inner diameter of the tubular spigot 140 of the top housing portion 108 such that the tubular spigot 140 forms a seal around the perimeter of the proximal end 174 of the valve stem 120. A distal end 176 of the valve stem 120 projects through the centre of the upper annular sealing gasket 160, which is dimensioned to seal against the outer surface 178 of the valve stem 120.

The valve stem 120 includes an outlet flow conduit 180 with an outlet aperture 182 at the distal end 176 and an inlet at the proximal end 174. The inlet comprises two diametrically opposed slots 178 (one of which can be seen clearly in FIG. 4) and two diametrically opposed holes 184 in the sidewall of the proximal end 174 of the valve stem 120 which allow for the passage of fluid into the outlet flow conduit 180. Preferably, each slot 178 has an area of 4 $mm^2$ or less. Preferably, each hole 184 has a diameter of 1 mm or less. These dimensions ensure that viscous fluid mixtures undergo a minimum pressure drop as they enter the outlet flow conduit 180 of the valve stem 120. The thickness of the distal end 176 of the valve stem 120 is preferably 0.5 mm or greater so that sufficient strength is provided to reduce the chance of breakage during operation of the valve stem.

It will be understood that alternative arrangements are envisaged where various combinations of holes 184 and/or slots 178 are provided and where their locations are varied.

The valve stem 120 further comprises a shoulder portion 186 which projects radially outwardly from a central region of the valve stem 120. The wall 186 is configured to abut against the upper sealing gasket 160 in a closed position so as to limit the upward movement of the valve stem, as can be seen in FIG. 1*a*. A radial protrusion 188 extends from the wall 186 toward the proximal end 174 of the valve stem 120. As can be seen in FIG. 1*b*, the radial protrusion 188 is configured to abut against the tubular spigot 140 so as to limit the downward movement of the valve stem in an open position.

The flow conduit 180 of the valve stem 120 is split into two portions. The portion at the distal end 176 has a length A and a diameter C and the portion at the proximal end 174 has a length B and a diameter D. Length A is preferably 14 mm and more preferably 13.8 mm. Length B is preferably 10 mm and more preferably 9.9 mm. The diameter C is preferably 1 mm and more preferably 1.1 mm. The diameter D is preferably 2 mm and more preferably 1.8 mm.

In an alternative arrangement, length A is preferably 9 mm and more preferably 8.7 mm. Length B is preferably 15 mm. The diameter C is preferably 1 mm and more preferably 1.1 mm. The diameter D is preferably 2 mm and more preferably 1.6 mm and more preferably 1.62 mm.

The overall valve stem 120 length is preferably 25 mm or less. Otherwise the manufacturability of the component will be significantly cumbersome and costly.

Advantageously, the flow path through the entire valve assembly 100 is designed such that the pressure drops are controlled and minimised resulting in improved control of atomising efficiency and flow rate. The flow conduit 180 is also designed and dimensioned to reduce turbulence therein. As such, the flow which leaves the outlet aperture 182, particularly when viscous products are used, is much less turbulent than would be the case were a conventional valve assembly to be used.

Turning now to the operation of the valve assembly 100, in the closed valve position, as shown in FIG. 1*a*, the shoulder portion 186 the shoulder 290 abuts against the upper sealing gasket 160 under force of the top spring 142. The ball 144 is biased against the lower annular sealing gasket 148 under force of the bottom spring 146 which creates a seal between the chamber 104 and the outlet flow conduit 180 of the valve stem 120. As such, no flow path exists between the inlet aperture 112 of the bottom housing portion 106 and the outlet aperture 182 of the valve stem 120. In other words, the valve assembly 100 is in a closed position as no fluid is able to flow through the valve assembly 100.

When the valve stem 120 is moved to the open valve position, as shown in FIG. 1*b*, the valve stem 120 is moved downwardly, conventionally by means of the actuator cap 30, such that the radial protrusion 188 of the valve stem 120 abuts against the tubular spigot 140. As can be seen in FIG. 1*b*, in the open position the proximal end 174 of the valve stem 120 has extended into the chamber 104 and pushed the ball 144 away from the lower annular sealing gasket 148 against the bias of the bottom spring 146. As such, a flow path has been created between the inlet aperture 112 of the bottom housing portion 106 and the outlet aperture 182 of the valve stem 120. The flow path passes from the inlet aperture 112, around the outside of the ball 144, to the outlet aperture 182 via the inlet of the valve stem 120 (i.e. the slots 178 and holes 184) and the outlet flow conduit 180. The contents of the container to which the valve assembly 100 is coupled can now flow out of the container through the valve assembly 100.

It will be appreciated that the ball 144 remains in fluid communication with the inlet aperture 112 throughout the range of movement of the valve stem 120. Further, the ball 144 remains in alignment with a longitudinal axis of the valve stem 120 throughout the range of movement of the valve stem 120. The bottom spring 146 is configured to retain the ball 144 in such an alignment with the longitudinal axis of the valve stem 120. The bottom spring 146 remains in constant contact with the ball 144 throughout the range of movement of the valve stem 120.

The design of the valve assembly 100 is such that the flow which leaves the outlet aperture 182, particularly when viscous products are used, is much less turbulent than would be the case were a conventional valve assembly to be used. As such, the valve assembly 100 can be used in conjunction with a Mechanical Break-Up Unit (MBU) when dispensing viscous products. Any suitable Mechanical Break-Up Unit can be used in conjunction with the valve assembly 100 to further improve consistency of performance. MBUs cannot be used with conventional valves when highly viscous products are being dispensed as blockage and clogging will occur due to geometrical design of the MBU.

Figure 5B:
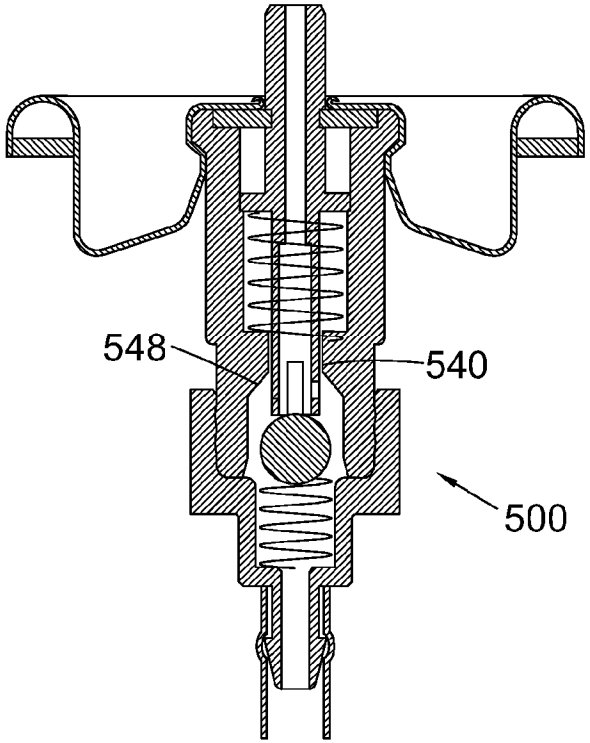
FIGS. 5*a* and 5*b* depict a cross-section of an alternative valve assembly in a closed and an open position respectively.
Figure 5A:
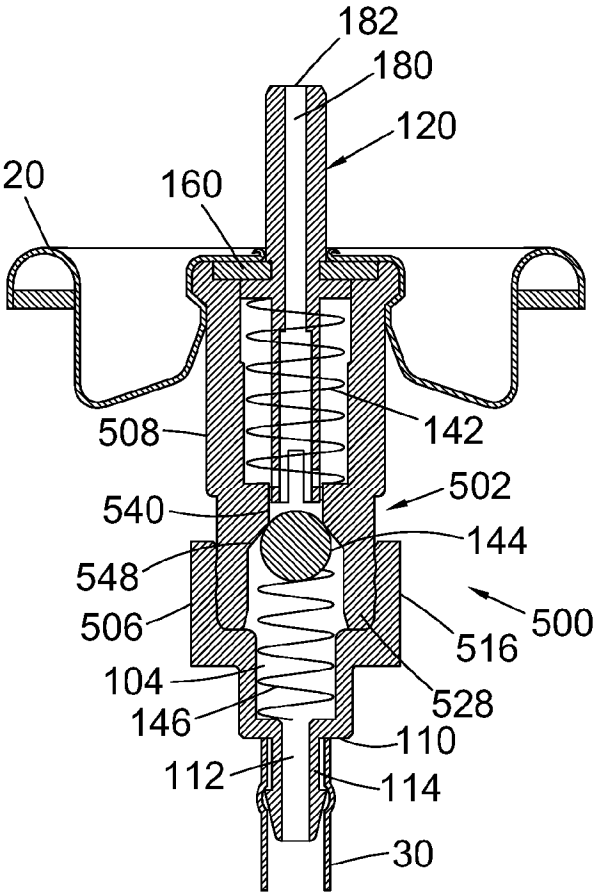

FIGS. 5*a* and 5*b* depict a cross-section of an alternative embodiment of a valve assembly 500 in a closed and an open position respectively. The design of the valve assembly 500 is substantially the same as that of the valve assembly 100 (depicted in FIGS. 1*a* and 1*b*) and like reference numerals are used in the Figures throughout this application to denote features that are substantially the same.

The key differences between the valve assembly 500 and the valve assembly 100 are that the tubular spigot 140 has been removed and replaced by an elongated wall section 540 which acts as a guide for the valve stem 120 in a similar manner to the spigot 140.

Figure 6:
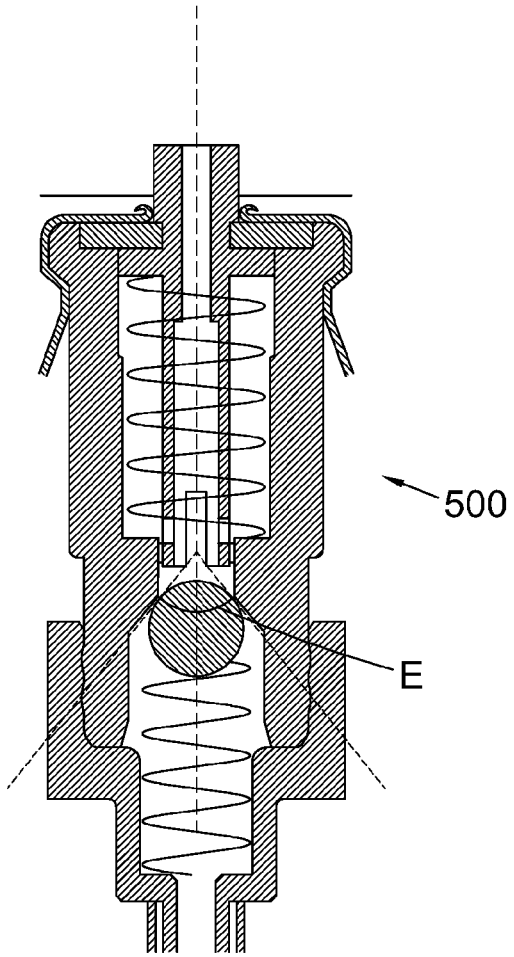
FIG. 6 depict a cross-section of the alternative embodiment of a valve assembly depicted in FIGS. 5*a* and 5*b*, again in the closed position.

Additionally, the lower annular sealing gasket 148 has been removed and replaced by an annular sealing surface 548 which is chamfered. Preferably, the angle E of the sealing surface 548 (depicted in FIG. 6) is 70° or less. Expressed in other words, the angle of annular sealing surface 548 relative to the longitudinal axis of the valve assembly 500 is 35° or less. This ensures that the ball 144, when biased against the annular sealing surface 548 under force of the bottom spring 146, creates a seal between the chamber 104 and the outlet flow conduit 180 of the valve stem 120.

The engagement between the top housing portion 508 and the bottom housing portion 506 of the valve assembly 500 is also slightly different to that of the valve assembly 100. Instead of a channel 116, the upper portion 516 of the bottom housing portion 506 has a wider diameter than the lower end 528 of the top housing portion 508 so as to fit with an interference fit outside of lower end 528 of the top housing portion 508.

The lower end 528 of the top housing portion 508 comprises annular protrusions which correspond to the annular recesses of the upper portion 516 of the bottom housing portion 506, much like those of the valve assembly 100. The arrangement of the annular protrusions and annular recesses is such that, once the lower end 528 of the top housing portion 108 is inserted into the upper portion 516 of the bottom housing portion 506, the top housing portion 508 is locked to the bottom housing portion 506.

As with the valve assembly 100, the internal walls of the housing 502 of the valve assembly 500 define a valve chamber 104.

The operation of the valve assembly 500 is much the same as that of the valve assembly 100, as is clear from FIGS. 5*a* and 5*b* which depict the similar operating mechanism of the valve 500.

Measuring the Loss Coefficient of a Valve

The protocol used for measuring the dimensionless pressure loss coefficient for a valve 1003 using a flow meter 1001 and a pressure measuring instrument 1002 (see FIGS. 8 and 9) is as follows.

Figure 8:
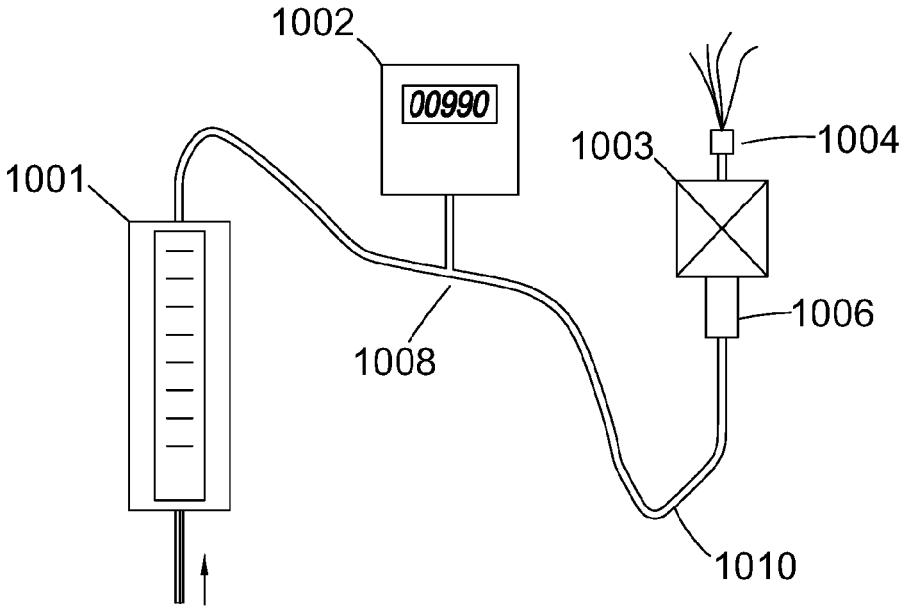
FIGS. 8 and 9 depict an apparatus for measuring the loss coefficient of a valve.
Figure 9:
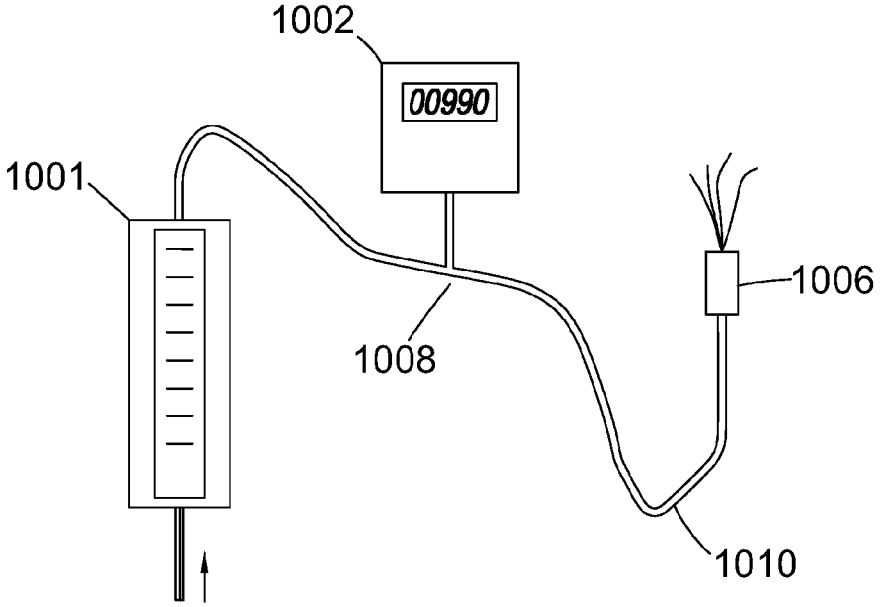

Referring to FIG. 8 the valve (1003) to be tested is mounted vertically with its outlet 1004 (at top). The inlet 1006 (at bottom) is connected to 4 mm internal diameter flexible tubing 1010 using adaptor fittings if required. The length of tube linking the valve with the pressure measurement position 1008 is 0.5 m It is essential that the pressure drop measured is representative of the valve itself and the pressure drop should not be influenced by additional loss creating components that may form part of an aerosol delivery device outlet or by the supply conduit to the valve. If such components, that do not form part of the valve, cannot be removed, their contribution to the pressure drop is taken into account by the procedure described below.

The outlet and inlet of the valve should be representative of those for normal usage of the valve but should be modified if necessary such that they contain no restrictions or orifices. Thus any gas bleed inlets should be blocked without interfering with liquid flow in the conduit.

Additionally, any restrictions to the flow along the outlet flow conduit 180 of the valve stem 120 should be removed by clearing the restriction (e.g. by drilling) to leave a passage of the same cross-section as the diameter of the outlet flow conduit 180. If the outlet of the valve, for example the internal chamber of the upper valve stem of a conventional valve, contains a restriction the stem should be drilled through or otherwise cleared to give a constant diameter for the outlet flow, with a value equal to that of the section of chamber without the restriction.

If it is necessary to remove the inlets and outlets to the valve then these should be replaced by replacement components with identical cross-sections and lengths to the originals. Thus, the internal cross-sections (e.g. diameters) of any replacement outlet and inlet should be representative of the values of the internal cross-sections (e.g. diameters) of those of the valve stem and valve feed conduit, from the dip tube, for normal usage of the valve.

The valve is supplied with distilled water, via the flow meter (1001), from a steady supply source at 20° C. The flow meter should be capable of providing measurements of water volume flow rate with 0.02 millilitre/sec accuracy, or better, and should cover at least the range from 0.2 millitres/sec to 2 millilitres/sec. A suitable flow meter is a PLATON Varying Area Glass tube flow meter with a calibrated type A1SS-CA 07100 tube and float combination obtainable from Roxpur Measurement and Control Ltd of Sheffield.

At point 1008 there is a junction at which a pressure measurement instrument (1002) is connected. This is preferably an electronic transducer type of device, designed for use with water, and should have an accuracy of 1.0 millibar (100 Pascals) or better with a range from zero up to at least 5 bar (5 kPa). A suitable instrument is a DRUCK DPI-705 Digital Pressure Indicator obtainable from DRUCK Ltd of Leicester. The outlet for the water at point 1004 should be at the same height as point 1008.

In order to compare different valves, a common liquid volume flow rate Q=1.0 millitres/sec is used, this being representative of that found in the stem in many consumer aerosol devices. In order to calculate a characteristic flow velocity V for a valve at which the valve is to be tested, the internal diameters of the inlet 1006 and outlet 1004 should be measured. If these are not equal then the smaller value should be recorded.

Now, the representative cross-sectional area A is given by the expression:

$$A=\pi D^2/4$$

where D is the internal diameter of the inlet 1006 and outlet 1004 if the same or the lesser of the two if different.

Also, the characteristic test velocity V is represented by the equation:

$$Q=V\times A.$$

It can be shown that when D has the units mm and V has units m/s then a value of Q in millilitres/sec can be obtained from the expression:

$$Q=\pi D^2 V/4 \text{ millilitres/sec}$$

Given that the value of Q employed is 1.0 millilitres/sec, the value of V (flow velocity) to be used in the test can be calculated from the expression:

$$V=4/(\pi D^2)$$

As an example for a representative diameter D=1.0 mm, the characteristic flow velocity for the test would be 1.27 m/sec.

To carry out a test the valve is fully opened and the test flow rate is set up. When steady conditions have been established the pressure $P_1$ is recorded. It is important to ensure that there are no bubbles or airlocks in the flow path or in the valve. The test should be repeated at least 5 times and an average value of $P_1$ should be used.

In order to remove the effects of pressure drops caused by other features of the flow between points 1008 and 1004, which are not part of the valve, a second test should be carried out. As shown schematically in FIG. 9, the valve is removed however the supply conduit to the valve is retained.

Figure 7:
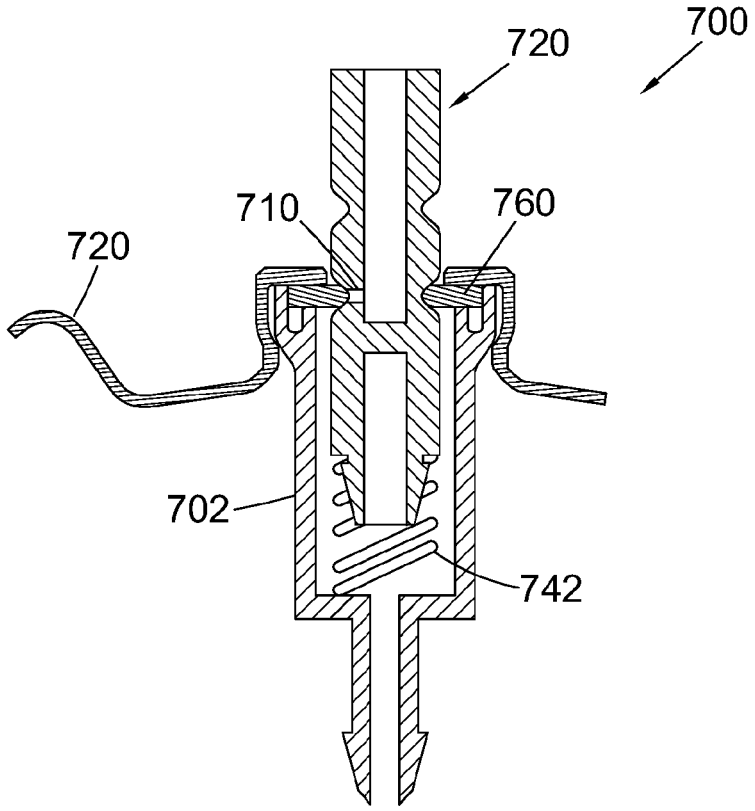
Fig. 7 PRIOR ART
FIG. 7 depicts a conventional aerosol valve assembly.

For a conventional aerosol valve, as shown in FIG. 7, the valve housing 702 is kept in place and connected to the water supply, however the valve stem 720, spring 742, sealing gasket 760 and metal aerosol cap 720 (into which the valve housing is normally crimped) are removed.

Figure 3:
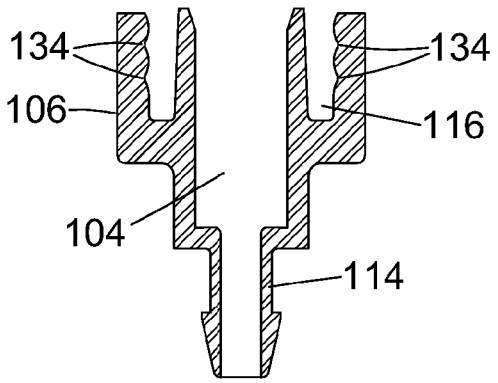
FIG. 3 depicts a cross-section of a bottom housing portion of the valve assembly depicted in FIGS. 1*a* and 1*b;*
Figure 4:
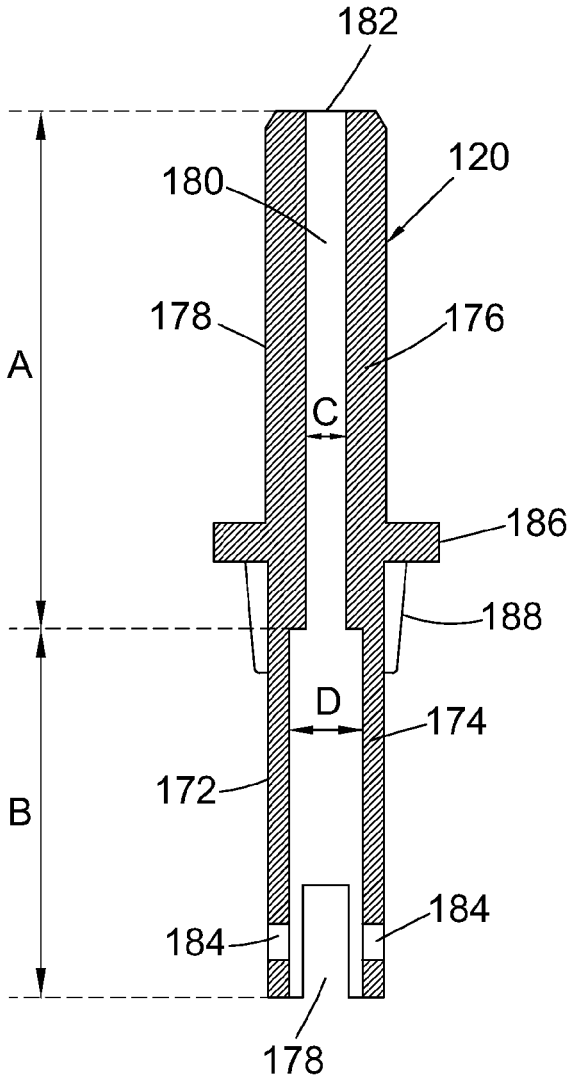
FIG. 4 depicts a cross-section of the valve stem of the valve assembly depicted in FIGS. 1*a* and 1*b;*

The procedure adopted in the case of the embodiment of the invention shown in FIGS. 1*a* and 1*b* of the accompanying drawings comprises attaching the bottom housing portion 106 illustrated in FIG. 3 to the tubing 1010.

A second test is carried out at the same flow rate as for the first test and a pressure $P_2$ is recorded.

The representative pressure drop for the valve is then found from:

$$\Delta P=P_1-P_2.$$

The dimensionless loss coefficient C of the valve is found by dividing this pressure drop ΔP by the dynamic head of the flow at the valve, the dynamic head being ½ $\rho V^2$ where ρ is the density of the water, so:

$$C=\Delta P/(\tfrac{1}{2}\rho V^2)$$

where ΔP has units Pascal, ρ has units kg/m$^3$, and V has units m/s.

EXAMPLE 1

A valve assembly 100 of the type shown in FIGS. 1*a* and 1*b* and a valve assembly 500 of the type shown in FIGS. 5*a* and 5*b*, both with flow conduit 180 of the distal end 176 or valve stem 120 and an outlet aperture 182 of 1 mm in diameter was tested in accordance with the above procedure for determining the dimensionless loss coefficient (C).

It was found that both valve assemblies had a loss coefficient (C) of less than 10.

COMPARATIVE EXAMPLE 2

This comparative example relates to the testing, using the above procedure, of a conventional aerosol valve assembly 700 illustrated in FIG. 7 which is of the type used with liquefied propellant hair spray aerosols.

The valve has a single inlet 710 for the stem 720 with diameter 0.5 mm. The characteristic diameter was the internal diameter of the stem which had D=1.8 mm.

Using the above procedure, the valve was found to have a loss coefficient (C) of 1750.

COMPARATIVE EXAMPLE 3

A conventional valve, of the type shown in FIG. 7 and described in comparative example 2, was modified by drilling 6 holes of 0.5 mm diameter as stem inlets 710, and also widening the channels through which the liquid must pass inside the valve.

Using the procedure described above, this modified conventional valve was found to have a loss coefficient (C) of 35.1.

The invention claimed is:

1. A valve assembly for a pressurized or pressurisable container of an aerosol spray device, the valve assembly comprising:

a housing with internal walls defining a valve chamber, the housing having a housing inlet for fluid communication with fluid in the container, the housing further comprising:

a top housing portion configured for attachment to a mounting cup, and a bottom housing portion;

a valve stem having a proximal end and a distal end, the proximal end received in the valve chamber and the distal end projecting through a sealed opening in the valve chamber, the valve stem including an outlet flow conduit with an outlet aperture at the distal end and, more proximally, at least one valve stem inlet;

a first sealing means disposed within the valve chamber, wherein the first sealing means comprises a ball;

a biasing means disposed within the valve chamber; and a second sealing means disposed within the valve chamber, wherein the valve stem is moveable between:

a closed position in which the first sealing means is biased against the second sealing means by the biasing means such that the housing inlet is not in fluid communication with the at least one valve stem inlet; and an open position in which the first sealing means is displaced from the second sealing means by the proximal end of the valve stem such that the housing inlet is in fluid communication with the at least one valve stem inlet, wherein, in the open position, a flow path is created from the housing inlet, around the outside of the first sealing means, and to the at least one valve stem inlet, and wherein the at least one valve stem inlet comprises one or more slot in a sidewall of the proximal end of the valve stem.

2. The valve assembly of claim 1, wherein the at least one valve stem inlet further comprises one or more holes.

3. The valve assembly of claim 1, wherein the at least one valve stem inlet is configured such that a flow path into the valve stem via the at least one valve stem inlet is in a direction perpendicular to a flow path from the at least one valve stem inlet through the valve stem to the outlet aperture.

4. The valve assembly of claim 1, wherein the biasing means is a spring.

5. The valve assembly of claim 1, wherein the biasing means is coaxially aligned with the valve stem.

6. The valve assembly of claim 1, wherein the housing is configured such that the first sealing means remains in fluid communication with the housing inlet throughout a range of movement of the valve stem.

7. The valve assembly of claim 1, wherein the housing is configured such that the first sealing means remains in alignment with a longitudinal axis of the valve stem throughout a range of movement of the valve stem.

8. The valve assembly of claim 1, wherein the biasing means is in constant contact with the first sealing means throughout a range of movement of the valve.

9. The valve assembly of claim 1, wherein the width of a portion of the valve chamber within which the ball is located is no more than 1.2 times the diameter of the ball.

10. The valve assembly of claim 9, wherein the width of the portion of the valve chamber within which the ball is located is 1.1 to 1.2 times the diameter of the ball.

11. The valve assembly of claim 9, wherein the width of the portion of the valve chamber within which the ball is located is 1.12 to 1.18 times the diameter of the ball.

12. The valve assembly of claim 1, wherein the second sealing means comprises a gasket.

13. The valve assembly of claim 1, wherein the second sealing means comprises a sealing surface.

14. The valve assembly of claim 13, wherein the sealing surface is chamfered.

15. The valve assembly of claim 1, wherein the biasing means is configured to retain the first sealing means in alignment with the longitudinal axis of the valve stem.

16. The valve assembly of claim 1, wherein the at least one valve stem inlet comprises two diametrically opposed slots and/or two diametrically opposed holes.

17. The valve assembly of claim 1, wherein the top housing portion and the bottom housing portion are joined by an interference fit.

18. The valve assembly of claim 1, wherein the bottom housing portion comprises a channel configured to receive the top housing portion.

19. The valve assembly of claim 18, wherein the channel further comprises annular recesses.

* * * * *